US008500606B2

(12) United States Patent
Nishimura

(10) Patent No.: US 8,500,606 B2
(45) Date of Patent: Aug. 6, 2013

(54) PARTLY-INLAID ELLIPTICAL GYMNASTICS EQUIPMENT

(76) Inventor: Takashi Nishimura, São Paulo (BR)

( * ) Notice: Subject to any disclaimer, the term of this patent is extended or adjusted under 35 U.S.C. 154(b) by 121 days.

(21) Appl. No.: 13/055,681

(22) PCT Filed: May 22, 2009

(86) PCT No.: PCT/BR2009/000144

§ 371 (c)(1),
(2), (4) Date: Jan. 24, 2011

(87) PCT Pub. No.: WO2010/009520

PCT Pub. Date: Jan. 28, 2010

(65) Prior Publication Data

US 2011/0124467 A1 May 26, 2011

(30) Foreign Application Priority Data

Jul. 25, 2008 (BR) ..... 0802479

(51) Int. Cl.
*A63B 22/00* (2006.01)

(52) U.S. Cl.
USPC ..... 482/57; 482/4

(58) Field of Classification Search
USPC ..... 482/1–9, 51–53, 57–65, 148
See application file for complete search history.

(56) References Cited

U.S. PATENT DOCUMENTS

| | | | | |
|---|---|---|---|---|
| 4,332,217 | A * | 6/1982 | Davis | 119/700 |
| 4,944,506 | A * | 7/1990 | Keller et al. | 482/54 |
| 5,108,088 | A * | 4/1992 | Keller et al. | 482/5 |
| 5,114,389 | A * | 5/1992 | Brentham | 482/53 |
| 6,746,375 | B2 * | 6/2004 | Smith et al. | 482/54 |
| 7,780,576 | B1 * | 8/2010 | Sudeith et al. | 482/37 |
| 7,967,728 | B2 * | 6/2011 | Zavadsky et al. | 482/5 |
| 7,972,249 | B1 * | 7/2011 | Napalan | 482/57 |
| 8,047,965 | B2 * | 11/2011 | Shea | 482/8 |
| 8,272,998 | B2 * | 9/2012 | Macartney et al. | 482/54 |
| 2005/0159275 | A1 * | 7/2005 | Bullman et al. | 482/111 |
| 2008/0058169 | A1 * | 3/2008 | Fox | 482/54 |
| 2009/0062072 | A1 * | 3/2009 | Packham | 482/4 |
| 2009/0259121 | A1 * | 10/2009 | Simonetti et al. | 600/410 |
| 2011/0251021 | A1 * | 10/2011 | Zavadsky et al. | 482/5 |

FOREIGN PATENT DOCUMENTS

WO WO-2004/108223 A1 12/2004

* cited by examiner

*Primary Examiner* — Stephen Crow

(74) *Attorney, Agent, or Firm* — Arent Fox LLP

(57) ABSTRACT

A partially-inlaid elliptical gymnastics equipment system includes a plurality of pedals connected to moving arms that move in synchronism with said pedals, at least one fixed member configured within a reach of a user, a panel for controlling and monitoring the equipment system, a mechanical and electric assembly that connects at least one pair of pedals and moving arms to define an elliptical system and promotes an alternating displacement of the at least one pair of pedals and arms, a vertical partition that includes a first pair of vertical windows through which distal end parts of bars pass, each bar connecting one the pedals to the elliptical system and a pair of vertical windows through which the moving arms pass, the moving arms being synchronized with the movements of the pedals, and an aisle providing access to the mechanical and electric assembly.

8 Claims, 2 Drawing Sheets

PARTLY-INLAID ELLIPTICAL GYMNASTICS EQUIPMENT

CROSS-REFERENCE TO RELATED APPLICATIONS

This application is the National Stage entry of international application No. PCT/BR2009/000144, filed May 22, 2009, and claims the priority of Brazil Application No. PI 0802479-0, filed Jul. 25, 2008, the entire specifications, claims and drawings of which are incorporated herewith by reference.

BACKGROUND

1. Field

The present invention is directed to a partly-inlaid elliptical gymnastics equipment and, more specifically, to a novel construction of the elliptical gymnastics equipment that makes it possible to place and use same in association with a structure that may or not be made of bricks, wherein the user can only access the control components and pedals of the elliptical gymnastics equipment.

2. Introduction

As it is known by the those skilled in the art and the users of the equipment, the so-called elliptical equipment used in fitness centers, condominiums and clubs consists of walking simulators provided with two large pedals that, when stepped on by the user, provide elliptical movements with a longer axis in the horizontal direction. In the front part of said equipment, a panel for controlling and monitoring the braking action is assembled on a column, as well as fixed or moving arms with handles that are synchronized with the movements of the feet.

In general, the elliptical equipment consists of machines where the user remains standing during the exercises. Because of this and the volume of the mechanism that makes out said equipment, a large cowling for covering same is required. Thus, a high front column provided with the relevant cowling is required to accommodate the arms with handles and the panel.

In addition to the dimensions of the cowling and the structure of said equipment, another critical aspect related to closed environments refers to the braking action of the equipment that may be carried out by dissipating heat to the surrounding air, said dissipation being attained by exchanging heat through the air conditioning system.

Thus, one of the Objects of the present invention is to provide a partly-inlaid elliptical gymnastics equipment that is not limited with connection with the size of the space required for the installation of the inner mechanism thereof.

Another object of the present invention is to provide a partly-inlaid elliptical gymnastics equipment that assures the sufficient cooling of its braking system so that the inner components thereof do not overheat and the ambient air of the fitness center is not involved in the heat dissipation necessary to cool the braking system.

Another object of the present invention is to provide a partly-inlaid elliptical gymnastics equipment that minimizes the transmission of its characteristic noises to the ambient air.

Another object of the present invention is to provide a partly-inlaid elliptical gymnastics equipment that allows for the maintenance or set up operations of eventual defects, even during the time the users are using the fitness center or club without noticing said operations.

SUMMARY

In order to solve all the problems presented by the conventional elliptical gymnastics equipment of the state of the art, the present patent application proposes a new solution that also aims at bringing a new proposal for fitness centers, where partly-inlaid elliptical gymnastics equipment changes radically the inner arrangement of the places where physical exercises are practiced collectively through this new concept.

These and other objects and advantages of the present invention are attained by a partly-inlaid elliptical gymnastics equipment comprised of pedals connected to moving arms that move in synchronism with said pedals, also comprising fixed arms within the reach of the hands of the user, the panel for controlling and monitoring the equipment being assembled between said arms, said pedals and moving arms being connected to a mechanical and electric assembly that defines the elliptical system that promotes of the alternating displacement of the pedals and arms.

In accordance with the present invention, a vertical partition provided in its lower part with a pair of vertical windows through which the end parts of bars pass is provided, to which parts the large pedals of the elliptical system are fixed so that rigid arms are fixed above the pedals and still on the partition, which arms extend until they can be reached by the hands of the user, and above same there is a pair of vertical windows through which the moving arms that are moved synchronized with the movements of the pedals pass; said partition also supporting the panel for controlling and monitoring the equipment between said arms; an aisle that may be accessed only by the staff responsible for the maintenance and set up of the mechanical and electric assembly that compose the elliptical system assembled to the pedals and moving arms along the wall or partition being defined in the part behind the partition; wherein part of the elliptical equipment hidden by the partition presents, without taking into account dimensional limitations and aesthetics, a longer and wider structure where its mechanical and electric components are exposed, without cowlings but provided with small coverings only in the parts that may be dangerous to the staff responsible for the maintenance or set up thereof.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

DETAILED DESCRIPTION

Figure 1:
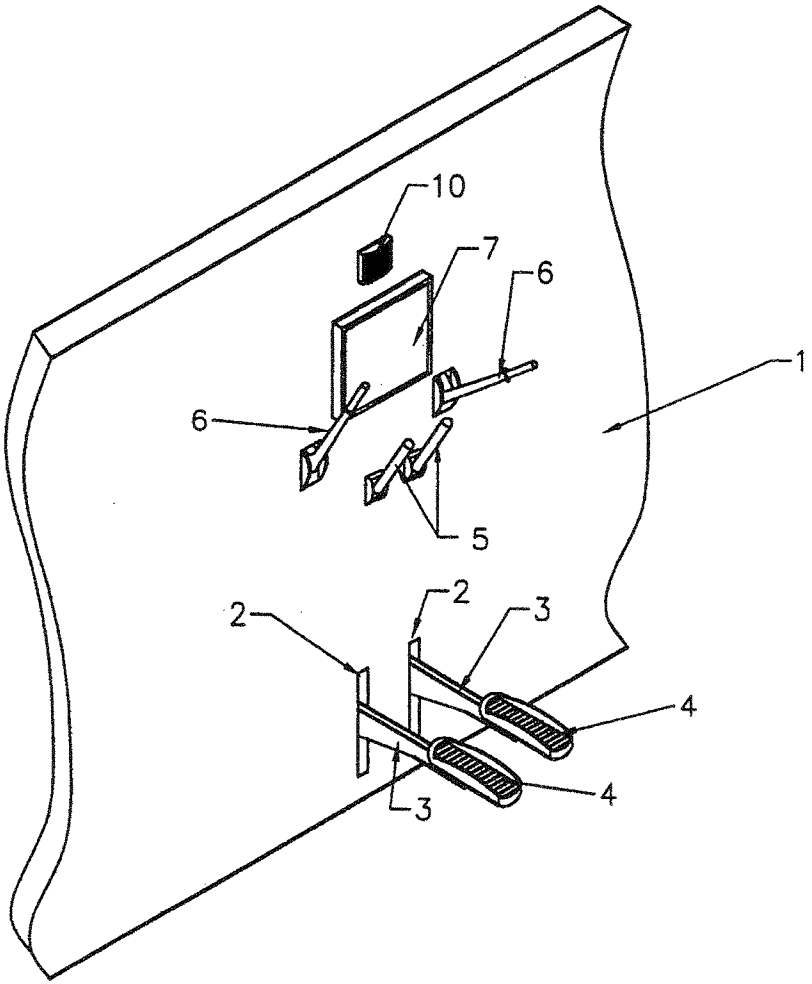
FIG. 1 depicts a partially illustrated perspective view of the wall of a fitness center, in which the partly-inlaid elliptical gymnastics equipment object of the present invention is assembled, in accordance with some aspects of the present invention.

As seen in these illustrations, the partly-inlaid elliptical gymnastics equipment object of the present invention is comprised of pedals 3, 4 interconnected to moving arms 6 that are moved in synchronism with said pedals 3, 4, and also comprised of fixed arms 5 that are kept within the reach of the hands of the user, the panel 7 for controlling and monitoring the equipment being assembled between said arms, said pedals 3,4 and moving arms being pivotally connected to a mechanical and electric assembly that defines the elliptical system 11, 12, 14, 15,16 that promotes of the alternating displacement of the pedals 3,4 and arms 6.

In accordance with the present invention, the partly-inlaid elliptical gymnastic equipment is provided or assembled beside a vertical partition 1 that is provided in the lower part thereof with a pair of vertical windows 2 through which the end portions of bars 3 pass, to which parts the large pedals 4 of the elliptical system are fixed.

Each bar 3 that passes through wall 1 has its back end pivoted to the elliptical assembly 14, 15, 16 and its intermediate portion pivoted to the vertical arm 13. Rigid arms 5 extend until they can be reached by the hands of the user, and above same there is a pair of vertical windows through which the moving arms that are moved synchronized with the movements of the pedals 3, 4 pass. Partition 1 also supports the panel 7 for controlling and monitoring the equipment between said arms 6.

Figure 2:
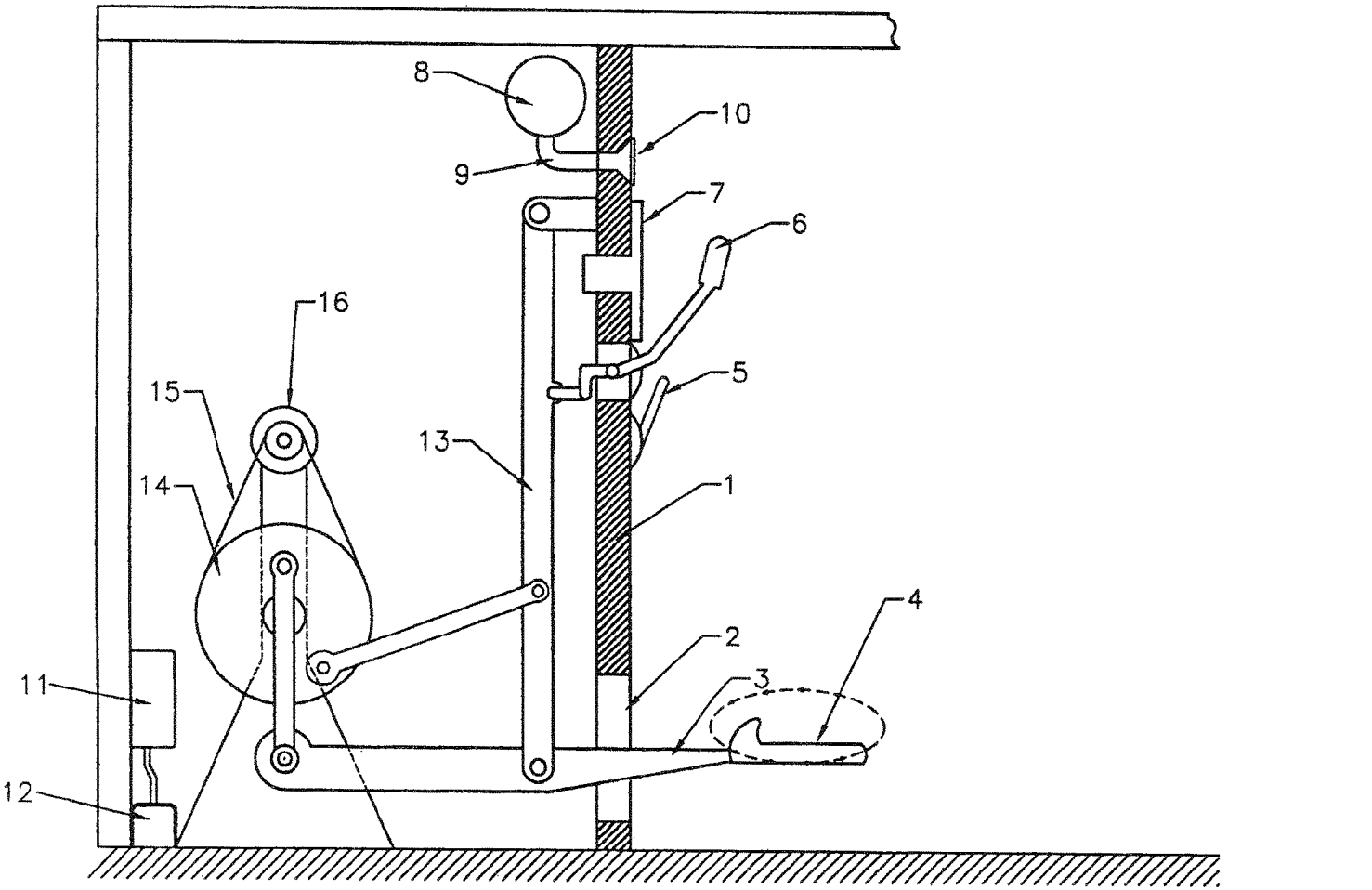
FIG. 2 depicts an elevation side view of the partly-inlaid elliptical gymnastics equipment, assembled through a wall or partition of the fitness center, in accordance with some aspects of the present invention.

As may be seen in FIG. 2, the rest of the elliptical equipment is shown, more specifically, what is behind the wall or partition 1. In spite of the fact that the figures illustrate only one equipment assembled through wall 1, it is clear that there is a plurality of equipment assembled parallel to one another and assembled to the same wall or partition 1 in a fitness center, in such a way that an aisle that may be accessed only by the staff responsible for the maintenance and set up of said equipment assembled on said wall 1 of the fitness center is defined on the part behind said wall 1.

This construction and assembly conception of the elliptical equipment exhibits more important characteristics that are not limited to the idea of simply cutting the structure of the equipment with a wall or partition. Indeed, such constructive conception makes it possible to conceive the hidden part of the elliptical equipment, without taking into account dimensional limitations and aesthetics, in such a way to have a longer and wider structure 13, 14, 15, 16 where its mechanical and electric components are exposed, without cowlings but provided with small coverings only in the parts that may be dangerous to the authorized staff responsible for the maintenance or set up thereof.

Thus, with reference to FIG. 2, an aisle that may be accessed only by the staff responsible for the maintenance and set up of the electrical mechanical assembly that compose the elliptical system 13, 14, 15, 16 that are assembled to the pedals 3, 4 and moving arms 6 along the wall or partition 1 is defined on the part behind said wall or partition 1.

In FIG. 2, said equipment that is mechanically connected to the external pedals 3, 4 and moving arms 6 by means of driving bars 13 may be distinguished. Thus, since the mechanic part of the elliptical system 14, 15, 16 is not any longer in the room destined to users of the fitness center, it may be optimized by adopting bars 13 that support the bars 3 of the pedals 4, with a longer extension, thus geometrically compromising the elliptical trajectory a little bit less.

The flywheel 14 that is part of the elliptical mechanism may have a higher diameter and be heavier in order to assure a course without any artificial measure and maintain the stability of the movement by having a sufficiently high moment of inertia.

The transmission belt 15 that interconnects the flywheel with the brake 16 may be made in only one stage, since there is no space limitation because of the cowling that is usually seen in the conventional elliptical systems.

In addition to the exclusive parts of each elliptical system, devices are disposed in said aisle that serve the group of elliptical systems, such as the central fan with a distribution duct 8 and derivations 9 that, in each elliptical system, communicate with directional air grids 10 that go through wall 1 and ventilate the user for his/her comfort. Also, the central low voltage power source is comprised of a transformer set, an electronic rectifier 11 and a battery 12, with distribution cables for the elliptical systems.

The heat generated by brake 16 is dissipated in the maintenance aisle, from where it may be removed by an exhauster. The electric part of the elliptical system is fed by the low voltage central equipment, thus eliminating the need for a pedal actuated generator. In the event there is lack of electric power in the fitness center, battery 12 will feed the panels for a long time.

Since there is no cowling, all the electric and mechanical parts are exposed in the maintenance aisle, thus making it easy to fix, lubricate and set up the system, with exclusive access to authorized people.

While the present invention has been described in connection with preferred aspects, it will be understood by those skilled in the art that variations and modifications of the preferred aspects described above may be made without departing from the scope of the invention. Other aspects will be apparent to those skilled in the art from a consideration of the specification or from a practice of the invention disclosed herein.

The invention claimed is:

1. A partially-inlaid elliptical equipment system comprising:

a plurality of pedals, each pedal connected to a moving arm that moves in synchronism with the pedal;

at least one fixed member configured within a reach of a user of the system;

a panel for controlling and monitoring the equipment system;

a mechanical and electric assembly that connects at least one pair of pedals and moving arms to define an elliptical system and promotes an alternating displacement of the at least one pair of pedals and arms;

a vertical partition comprising:

a first pair of vertical windows through which distal end parts of bars each bar connecting one of the pedals to the elliptical system a second pair of vertical windows through which the moving arms pass, the moving arms being synchronized with the movements of the pedals;

wherein the partition supports the at least one fixed member at a position above the pedals and supports the panel for controlling and monitoring the equipment between the moving arms; and an aisle providing access to the mechanical and electric assembly of the elliptical system provided on an opposite side of the partition from the pedals and moving arms.

2. The partially-inlaid elliptical equipment system according to claim 1, wherein the mechanical and electric assembly of the elliptical system on the opposite side of the partition defines a longer and wider structure including mechanical and electric components that are exposed, wherein the exposed mechanical and electric components are provided with coverings.

3. The partially-inlaid elliptical equipment system according to claim 1 wherein the pedals and the moving arms are pivotally connected to one another by means of vertical transmission arms that are pivotally interconnected with the mechanical and electric assembly that defines the elliptical system.

4. The partially-inlaid elliptical equipment system according to claim wherein each bar that passes through the partition further comprises:

a back end articulated to the mechanical and electric assembly that defines the elliptical system; and an intermediate portion articulated to the vertical.

5. The partially-inlaid elliptical equipment system according to claim 4, wherein the mechanical and electric assembly comprises:

a flywheel that composes an elliptical mechanism having a diameter and weight to provide a course without any artificial measure and maintain the stability of movement by having a sufficiently high moment of inertia.

6. The partially-inlaid elliptical equipment system according to claim 5, wherein the mechanical and electrical assembly further comprises:

a one stage transmission belt that interconnects the flywheel with a brake.

7. The partially-inlaid elliptical equipment system according to claim 1, further comprising:

devices provided in the aisle to serve a group of elliptical systems, the devices including a central fan with a distribution duct and derivations that, in each elliptical system, communicate with directional air grids that go through the partition and ventilate the user for comfort.

8. The partially-inlaid elliptical equipment system according to claim 1, further comprising:

a central low voltage power source comprising:

a transformer set;

an electronic rectifier; and a battery with distribution cables for the elliptical system.

* * * * *